United States Patent [19]

Smith et al.

[11] 4,247,382

[45] Jan. 27, 1981

[54] CATHODE ASSEMBLY FOR ELECTRO-CHEMICAL APPARATUS

[76] Inventors: Noel E. Smith; Christopher J. Smith, both of 1099 Tillinghast Rd. East, Greenwich, R.I. 02818

[21] Appl. No.: 58,513

[22] Filed: Jul. 18, 1979

Related U.S. Application Data

[63] Continuation-in-part of Ser. No. 916,828, Jun. 19, 1978, abandoned.

[51] Int. Cl.[3] ..... C25D 17/08; C25D 17/10

[52] U.S. Cl. ..... 204/297 R; 204/286; 204/297 W

[58] Field of Search ..... 204/213, 279, 286, 288, 204/297 R, 297 W, 297 M

[56] References Cited

U.S. PATENT DOCUMENTS

| | | | |
|---|---|---|---|
| 1,022,794 | 4/1912 | Lutz | 204/297 W |
| 2,872,544 | 2/1959 | Hoffman | 204/213 X |
| 3,039,950 | 6/1962 | Oelgoetz | 204/242 |
| 3,366,566 | 1/1968 | Sandrock | 204/213 X |
| 3,844,923 | 10/1974 | Sandrock | 204/279 |
| 4,088,560 | 5/1978 | Swinehart et al. | 204/297 W |

FOREIGN PATENT DOCUMENTS

| | | | |
|---|---|---|---|
| 1582003 | 8/1969 | France | 204/297 W |

OTHER PUBLICATIONS

Plating Rack Manual by Belke, pp. 26, 32, Pub. by Belke Mfg. Co., Chicago (1947).

*Primary Examiner*—F. C. Edmundson
*Attorney, Agent, or Firm*—William Frederick Werner

[57] ABSTRACT

A cathode frame for an electro-chemical apparatus, such as an electroplating tank, is provided with a plurality of contactors removably attached to the electrical conductor bar in order to be discarded and readily replaced by another contactor after the plating material "builds-up" on the contactor to a condition where the plating inhibits electrical conductivity.

3 Claims, 7 Drawing Figures

10
31
20
27
30
26
28
17
41
14
16
21
25
18
36A
35
11
5
5
37A
19
15
13
12
38
38A
38B 73
51A
60B
60A
59c
51B 70
71
72

41

36
37
35
4
6
6
40
4

59C
51A
73
50
40
38
60A
70
71
51
52
60B

72

59
61
50
40
38

62
51
52
63
60

40
36

40
38
62A
81

60A
63A
83
82

CATHODE ASSEMBLY FOR ELECTRO-CHEMICAL APPARATUS

PRIOR ART

The present application is a continuation-in-part of United States Patent Application Ser. No. 916,828 filed June 19, 1978, now abandoned, and represents an improvement upon cathode assemblies, such as disclosed in U.S. Pat. Nos. 2,249,609; 3,366,566; 3,803,007; 3,844,923; 3,846,271.

STATEMENT OF INVENTION

The subject cathode assembly comprises a frame or cathode core of electrical conductive material, insulated, with the insulation selectively removed to provide attachment of a cathode auxiliary extension to the cathode core or frame.

Presently known cathode assemblies do not permit the manual finger removal of a contactor from a cathode core.

OBJECTS OF THE INVENTION

Accordingly, it is a principal object of the present invention to provide an easily removable throw-away contactor for a cathode or electrical conductor core.

Another object of the present invention is to eliminate the need mechanically of hammering or chemically removing the plating "build-up" on the contactor of a cathode electrical conductor core.

Other objects of the present invention will become apparent in part and be pointed out in part in the following specification and claims.

BRIEF DESCRIPTION OF DRAWINGS

Referring to the drawings in which similar reference characters refer to the same parts.

THE SPECIFICATION

Figure 1:
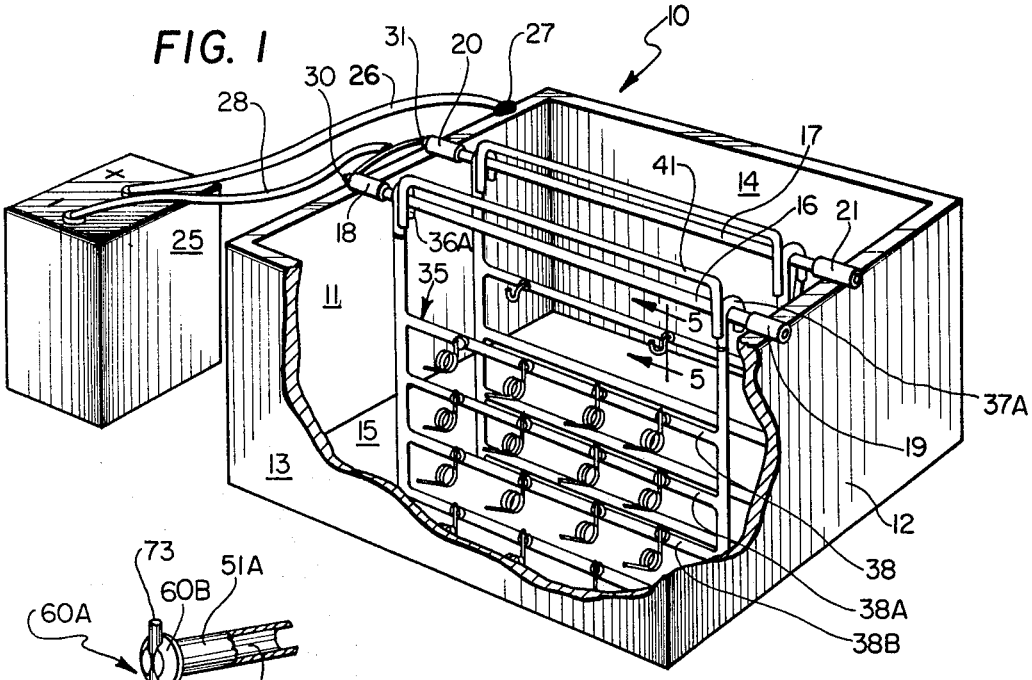
FIG. 1 is a perspective view, partly in section, illustrating an eletro-plating tank.

The electro-plating tank is, generally, designated by reference numeral 10. It consists of a left side wall 11, a right side wall 12, a front wall 13, a rear wall 14 and a bottom 15, all integrally connected to form an open top tank, fabricated from electrically conductive material.

Cathode bars 16, 17 are provided on each end, respectively, with electrical insulation, 18, 19 and 20, 21. Ends 18, 20 rest on the top of wall 11. Ends 19, 21 rest upon the top of wall 12. Electrical insulation 18, 19, 20, 21 electrically insulates the cathode bars 16, 17 from the tank 10.

A power source 25 is provided with a positive electrical connection 26 which attaches at 27 to the top of wall 11; and with a negative electrical connection 28 which attaches to cathode bars 16, 17 at 30, 31 respectively.

A frame or cathode core, generally, indicated by reference numeral 35, comprises two parallel sides 36, 37 having, respectively, bent over ends forming hooks 36A, 37A adapted to hang upon cathode bars 16 and/or 17. A plurality of cross members 38, 38A, 38B, etc., are integrally attached on opposite ends to sides 36, 37, respectively. The sides 36, 37 and the cross members 38, 38A, 38B, etc., are electrically conductive and therefore, provided with electrical insulation 40 in the appropriate areas. For example, the hooks 36A, 37A are free from electrical insulation so that proper electrical conductivity exists between said hooks 36A, 37A and said cathode bars 16 and/or 17. A handle 41, electrically insulated is fastened to frame 35, as at sides 36, 37.

The electro-plating solution in tank 10 is electrically positive, so that frame 35 is electrically insulated from the solution except for selected areas about to be described and which form the essence of the present invention.

Figure 2:
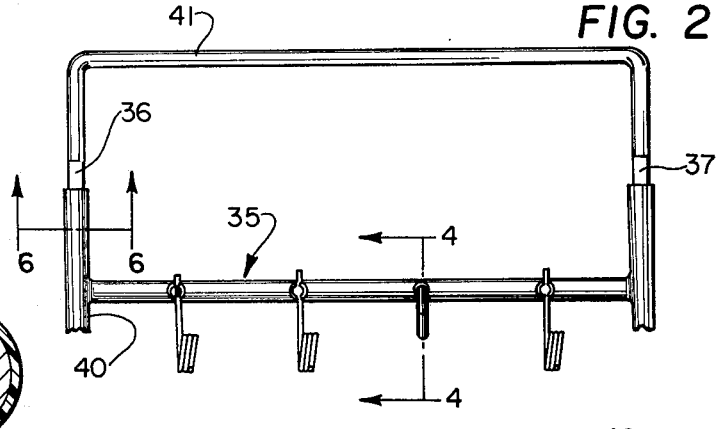
FIG. 2 is a front elevational view of the new and improved cathode core frame.
Figure 7:
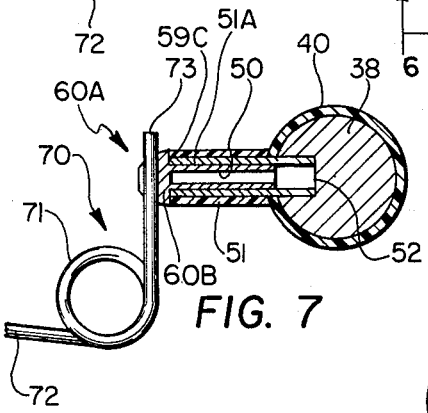
FIG. 7 is a view similar to FIG. 4 showing the contactor of FIG. 3 attached to cathode auxiliary extension.
Figure 4:
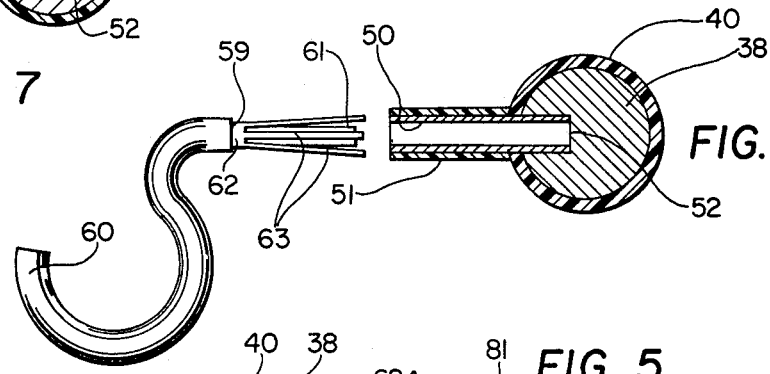
FIG. 4 is a cross sectional view, taken on line 4—4 of FIG. 2, showing a modified form of contactor.
Figure 6:
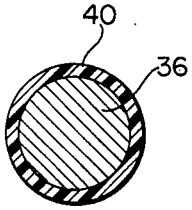
FIG. 6 is a horizontal cross sectional view, taken on line 6—6 of FIG. 2.

Attention is directed to FIGS. 2 and 4 where a hollow stem 50, fastened to cross member 38, projects therefrom. Insulation 51 is provided around the outside diameter of hollow stem 50, and abuts insulation 40.

A contactor 60 in the form of a hook is provided with a contactor inboard end 59 provided with reduced area 61 projecting therefrom. A collar 62 provided with a plurality of spring fingers 63 is fastened to projection 61. Projection 61 and spring fingers 63 slidably engage sleeve 50 and are manually removable from said sleeve 50 under the adverse condition of having contactor 60 encrusted with electro-plating material. Contactor inboard end 59 engages insulation 51 in fluid tight relation.

Figure 3:
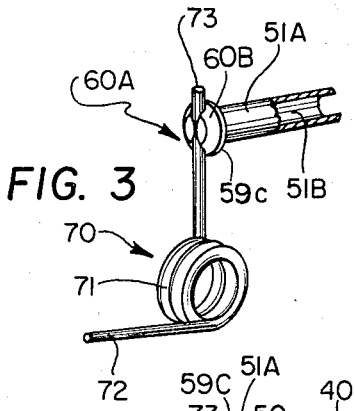
FIG. 3 is a perspective view, partly in section, of a contactor.

FIG. 3 illustrates a modified form of contactor, generally indicated by reference numeral 60A, comprising a tube 51A having a hollow core 51B, a flanged end 60B and a shoulder 59C between said end and core. A coil spring holder, generally, indicated with reference numeral 70, consists of a plurality of convolutions 71 having a free end 72 and an end 73 fastened to said tube 51A. Tube 51A is adapted to slide into hollow stem 50 and be manually removable from said stem 50. The contactor 60A at shoulder 59C must abut insulation 51 in fluid tight relation during the electroplating cycle.

Figure 5:
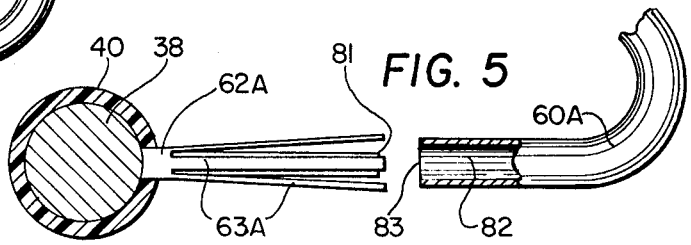
FIG. 5 is a cross sectional view, taken on line 5—5 of FIG. 1.

FIG. 5 illustrates still another modified form of contactor which is a construction opposite to the structure illustrated in FIG. 4. A stem 81 is fastened to and projects from cross member 38. A collar 62A provided with a plurality of spring fingers 63A is fastened to stem 81. A contactor 60A having an axial bore 82 is slidably retained upon spring fingers 63A. Inboard end 83 must abut insulation 40 in fluid tight relation, or a suitable nonelectrical conductive fluid tight seal must be interposed between the contactor and the frame during the electro-plating cycle to prevent encrustation of plating material between contactor 60A and collar 62A.

In operation, frame 35 is suspended into tank 10 containing an electro-plating solution. Articles to be electro-plated, such as articles of jewelry, for example, will be held by contactors shown in FIGS. 1, 2, 3, 4 and 5 and immerged in the solution. Power source 25 will send electrical current through positive electrical connection 26 so as to electrically energize tank 10 and the plating solution contained therein.

The electrical current will react to deposit a coating on every metallic or electrically active surface such as the articles held by the contactors and upon the contactors themselves because said contactors are electrically connected to the cathode core forming the frame 35. Obviously, the insulation prevents the electroletic deposit of the plating on the insulation.

At the end of the electroletic deposit upon the articles held by the contactors frame 35 is removed from the tank by means of handle 41. The articles are removed from the contactors and are replaced by other articles to be plated. After a period of time coating deposits "build-up" upon the contactors to the extent that electrical current feebly passes through the contactors to the detriment of the plating operation. The contactors must be replaced. With the advent of the present construction, weak fingers can remove the contactors from the cathode frame and replace unplated contactors upon the cathode auxiliary extensions. The operation is then repeated.

Having shown and described preferred embodiments of the present invention by way of example, it should be realized that structural changes could be made and other examples given without departing from either the spirit or scope of this invention.

What we claim is:

1. A cathode assembly for electro-chemical apparatus comprising:

(a) an electrically conductive cathode frame having opposing parallel sides and at least one cross member having opposite first and second ends, said first end of said cross member being fastened to a first of said parallel sides and said second end of said cross member being fastened to a second of said parallel sides, (b) electrical insulation covering generally the entire surface of said cathode frame, (c) at least one electrically conductive cathode auxiliary extension having an outer surface, said extension being generally circular in cross-section and having a bore therethrough, (d) said extension being connected at one of its ends to said cross member and projecting outwardly therefrom and having an outer terminus formed as a flat end, (e) a layer of insulation covering said outer surface of said extension, said layer of insulation being in fluid tight contact with electrical insulation covering said cross member, (f) said layer of insulation covering said extension being coterminous with said extension and having an outer flat end residing in the same plane as said flat end of said extension, (g) the flat ends of said extension and said layer of insulation presenting a common flat face, (h) an electrically conductive contactor having first and second ends, the first end of said contactor being formed as a flat face and being generally circular in cross-section, (i) the cross-sectional dimensions of the first end of said contactor and said common flat face being generally equal whereby said first end of said contactor facially engages the full surface of said common flat face when said first end of said contactor is in facial engagement with said common flat face while overlapping engagement of said contactor with said extension is precluded, and (j) electrically conductive gripping means connected with said first contactor end and engageable with the major length of the interior of the bore of said extension and operable to secure said contactor with said extension and permit flow of electricity through said frame and to said contactor, (k) said gripping means being arranged to hold said first end of said contactor in facial engagement with said common flat face.

2. Apparatus as set forth in claim 1 wherein said gripping element includes a plurality of spring fingers engageable with the major length of the interior of the bore of said extension.

3. Apparatus as set forth in claim 1 wherein said gripping means is a tube engageable with the major length of the interior of the bore of said extension.

* * * * *